US005088725A

United States Patent [19]

Arnold

[11] Patent Number: 5,088,725

[45] Date of Patent: Feb. 18, 1992

[54] EXERCISE DEVICES

[76] Inventor: Gene W. Arnold, 204 Seventh Ave., S., Greenwood, Mo. 64034

[21] Appl. No.: 580,168

[22] Filed: Sep. 10, 1990

[51] Int. Cl.[5] ..... A63B 21/06

[52] U.S. Cl. ..... 272/117; 272/122

[58] Field of Search ..... 272/67, 96, 117, 119, 272/122, 123, 143, 124

[56] References Cited

U.S. PATENT DOCUMENTS

| | | | |
|---|---|---|---|
| 1,658,108 | 2/1928 | Vaughn | 272/67 |
| 2,114,790 | 4/1938 | Venables | 272/122 X |
| 3,904,198 | 9/1975 | Jones | 272/123 |
| 4,231,569 | 11/1980 | Rae | 272/122 |
| 4,345,756 | 8/1982 | Hoagland | 272/117 |
| 4,411,422 | 10/1983 | Solloway | 272/96 |
| 4,484,740 | 11/1984 | Green | 272/122 X |
| 4,607,840 | 8/1986 | Harper | 272/117 |
| 4,848,325 | 7/1989 | Lillie | 272/96 |
| 4,964,631 | 10/1990 | Marano | 272/117 |

*Primary Examiner*—Robert Bahr
*Attorney, Agent, or Firm*—Michael Yakimo, Jr.

[57] ABSTRACT

A pair of exercise devices for respectively performing the "curl" and "fly" exercise. Each device utilizes a clamping assembly for receiving a range of user selectable free weights therein. Each clamping assembly is associated with a support assembly for the lower arm of the user. Upon the user grouping a handle the "curl" and "fly" exercises are performed with the clamped weight of the respective devices offering resistance thereto.

7 Claims, 3 Drawing Sheets

EXERCISE DEVICES

BACKGROUND OF THE INVENTION

This invention pertains to exercise devices, and more particularly, to exercise devices utilized in weight training and body building endeavors.

Various exercise devices have been utilized for enhancing muscular development. Said devices include free weights, universal machines, nautilus machines and weight training stands, racks, benches, etc. These devices are designed to firm the body musculature and/or enhance the definition and size thereof. Various weight training devices allow for the performance of certain exercises designated as the "curl" and "fly" exercises. However, some of these devices are relatively high in cost and thus not economical for home purchase. Moreover, the large size of some of these devices may not make them adaptable for home use. Thus, it is desirable to provide a device which is economical to manufacture, low in cost and effective in use so as to enhance performance of these "curl" and "fly" exercises and variations thereof.

In response thereto, I have invented exercise devices for enhancing the performance of the "fly" and "curl" exercises. These devices are relatively economical to manufacture, relatively low in cost and can be used by the home user with conventional weights. Thus, the need to purchase expensive weight machines is eliminated.

My device generally comprises an enclosure for the lower arm of the user with an associated weight clamping assembly. The clamping assembly allows for releasable insertion of weights therein. Insertion of the lower arm into the enclosure allows the user to grasp the handle and perform the "curl" or "fly" exercises with the clamped weights offering resistance to the user. The displacement of the weights relative to the hand of the user has been found to enhance muscular development afforded by these exercises.

It is therefor a general object of this invention to provide weight training devices which enhance muscular development.

Another object of this invention is to provide a weight training device, as aforesaid, which enhances the chest, shoulder and tricep muscular development.

Still another object of this invention is to provide a weight training device, as aforesaid, which enhances the forearm, latissimus and tricep muscle development.

A still further object of this invention is to provide an exercise device, as aforesaid, which precludes the need to utilize expensive weight training machines.

Another object of this invention is to provide exercise devices, as aforesaid, which are easily used in the home and with conventional weights of user-selectable poundage.

A further object of this invention is to provide exercise devices, as aforesaid, which displaces the conventional weights from the hand of the user.

A particular object of this invention is to provide exercise devices, as aforesaid, which allows for rotation of conventional weights during use so as to enhance the associated exercise.

Other objects and advantages of this invention will become apparent from the following description taken in connection with the accompanying drawings, wherein is set forth by way of illustration and example, embodiments of these inventions.

BRIEF DESCRIPTION OF THE DRAWINGS

FIG. 7 is a front elevation view of the apparatus as shown in FIGS. 5 and 6.

DESCRIPTION OF THE PREFERRED EMBODIMENT

Figure 1:
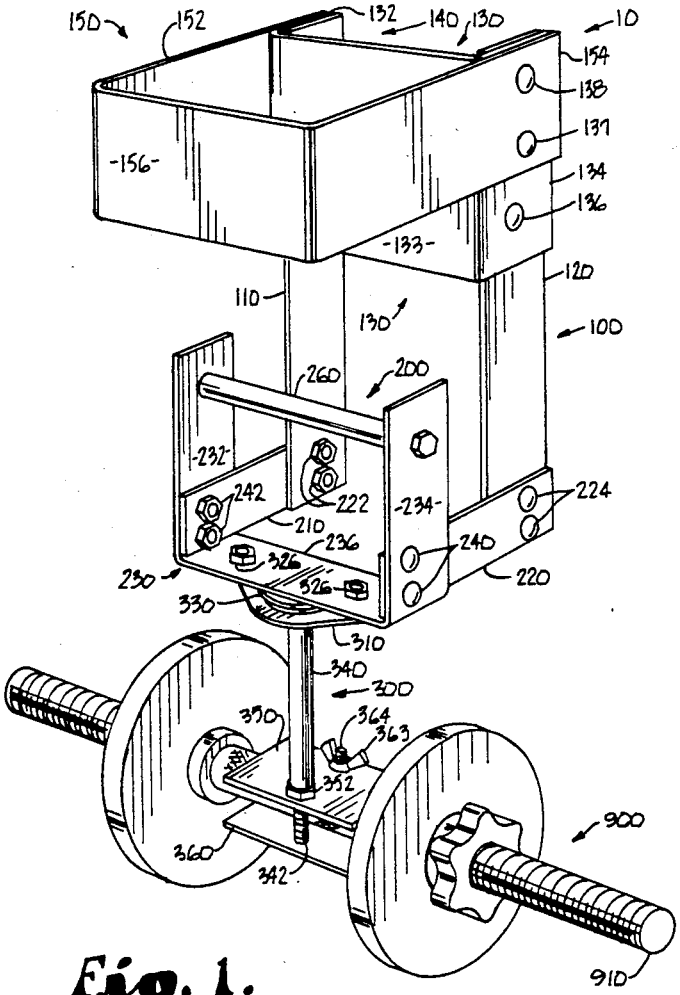
FIG. 1 is a perspective view illustrating an exercise device primarily used for performing a bicep "curl"

Turning more particularly to the drawings, FIG. 1 illustrates the "curl" exercise device 10 utilized for enhancement of primarily the bicep muscles. As shown in FIG. 1, the device includes three major assemblies, i.e. an arm support assembly 100, handle assembly 200 and a clamping assembly 300. The support assembly 100 generally comprises first and second elongated struts 110, 120 having a forearm rest/leverage plate 130 extending between the struts 110, 120 at the proximal end 140 thereof. The plate 130 includes a pair of laterally-spaced walls 132, 134 with a web 133 spanning said walls 132, 134. Bolt/nut combinations 136, 137, 138 or rivets attach wall 134 to strut 120 with similar bolt/nut combinations or rivets (not shown) attaching the opposite wall 132 to the opposite strut 110.

Further attached to the struts 110, 120 at end 140 is a U-shaped restraint brace 150 comprising a pair of laterally spaced-apart struts 152, 154 with spanning web 156. Strut 154 normally extends from rest plate wall 134 and from strut 120 by the above-mentioned bolt/nut combinations 137, 138 extending therethrough. Similar bolt/nut combinations attach strut 152 to the opposite strut 110 and atop the opposite wall 132 in a normally extending relationship thereto.

Figure 2:
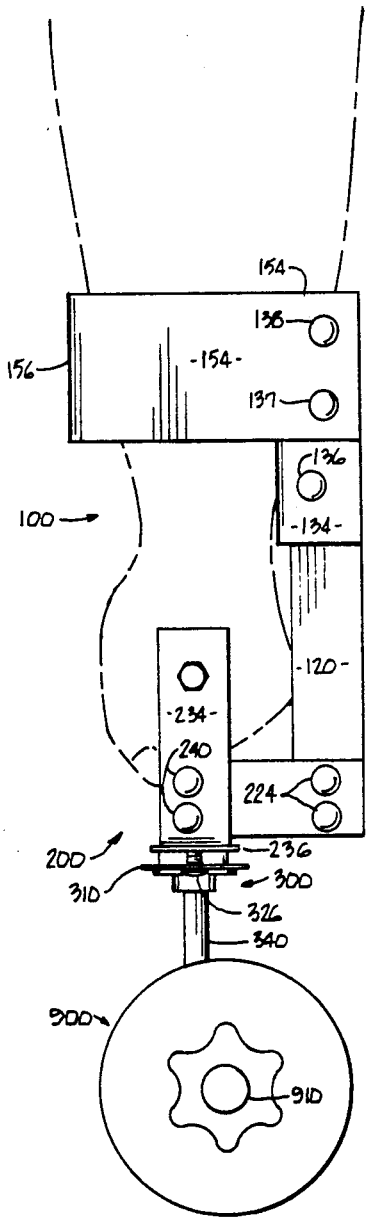
FIG. 2 is a side view of the device in FIG. 1 in a vertical or starting position with a lower arm of a user inserted therein.
Figure 3:
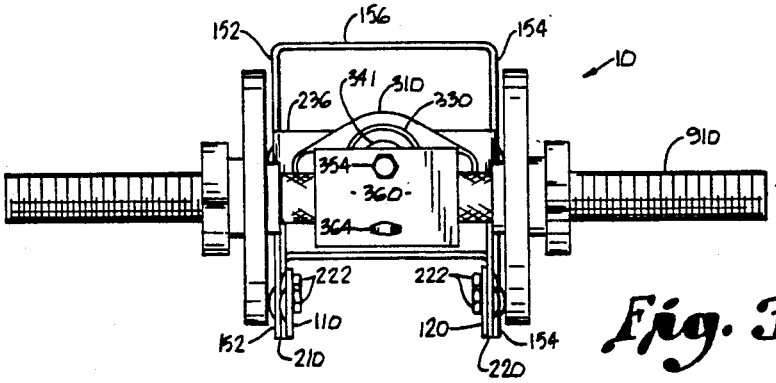
FIG. 3 is a bottom view of the apparatus as illustrated in FIGS. 1 and 2.
Figure 1:
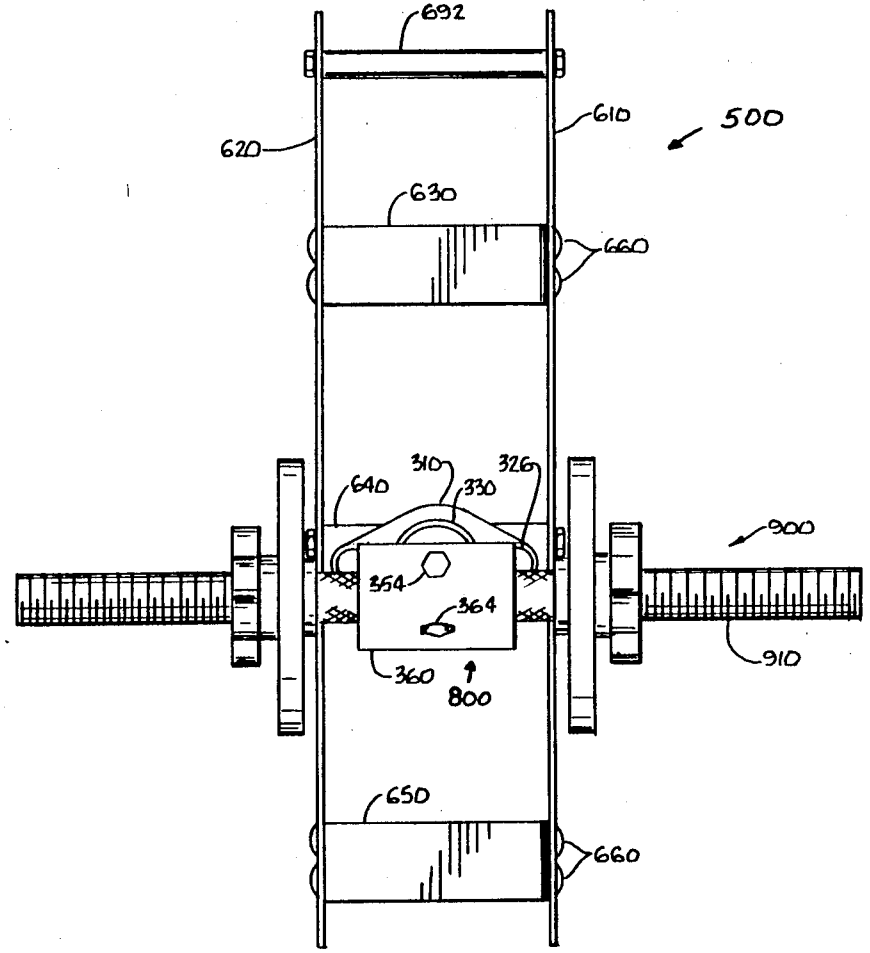

As shown in FIG. 2, upon the above-described attachment web 156 is displaced from the underlying web 133 of rest plate 130 to allow for insertion of the hand and forearm of the user therethrough.

Attached to the opposed end of struts 110, 120 is the handle assembly 200. This assembly 200 comprises a pair of struts 210, 220 normally extending from the distal end of struts 110, 120 and attached thereto by nut/bolt combinations 222, 224.

A U-shaped mounting brace 230 having a pair of arms 232, 234 and a spanning web 236 is attached to the free end of struts 210, 220 by nut/bolt combinations 240, 242. A bar 260 extends between the free end of arms 232, 234 for grasping by the hand of the user as shown in FIG. 2.

Figure 4:
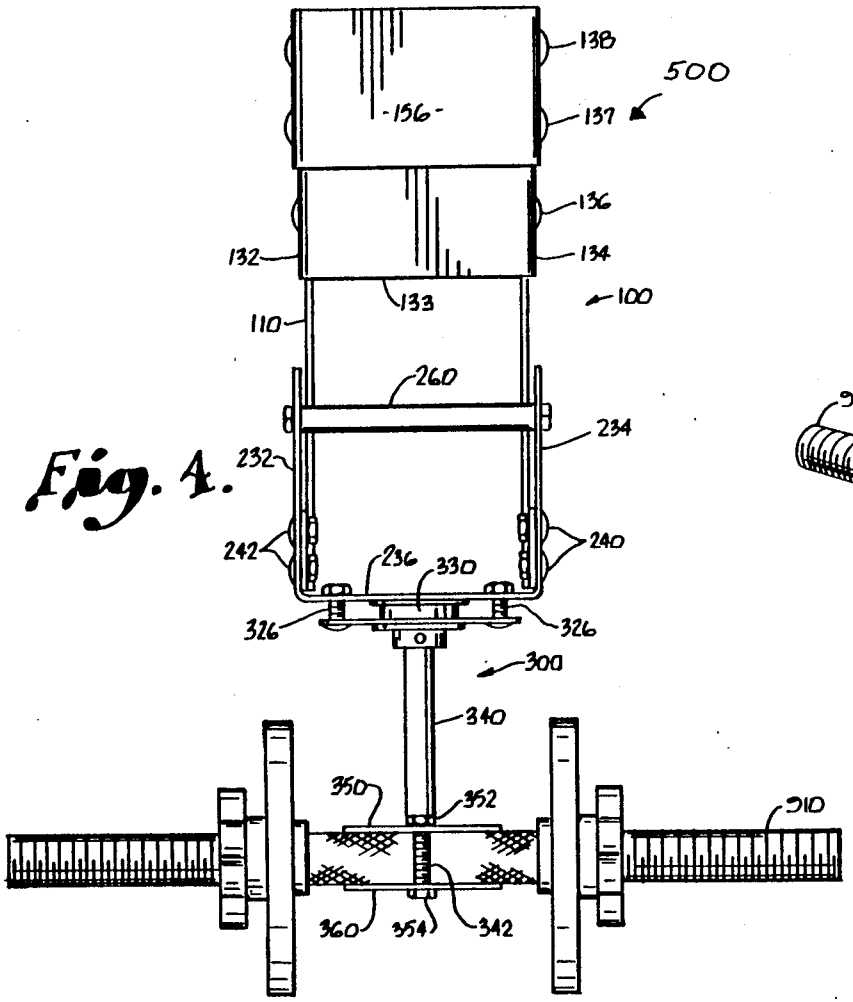
FIG. 4 is a rear elevation view of the apparatus shown in FIGS. 1 and 2.

Extending from the web 236 is the clamping assembly 300. This assembly comprises a flange plate 310 attached to web 236 by spacer nut/bolt combinations 326 as best seen in FIG. 4. As such the flange plate 310 is spaced from web 236. Inserted within a central aperture in the flange plate 310 is a rotatable bearing 330. An elongated bolt 340 with flared head 341 extends through the bearing 330 and presents a threaded end 342 at the free end thereof.

Attached at the end of the bolt 340 are first and second clamping plates 350, 360. Spaced-apart nuts 352, 354 functionally engage the threaded end 342 of bolt 340 adjacent plate 360. A bolt 364 extends through the plates 350, 360 and is held in place by wing nut 363.

Removal of the bolt 364 allows for insertion of the bar 910 of a free weight 900 between the clamping plates 350, 360. Upon insertion the bolt 364 is then extended through the plates 350, 360 with the wing nut 363 tightened thereto. This arrangement clamps the bar 910 of the free weight 900 between the clamping plates 350, 360 and between the bolts 340, 364 so as to preclude undesirable displacement of the weight 900 and bar 910 during use.

In use the user extends his fist and forearm through the restraining brace 150 so as to grasp the handle/bar 260 as shown in FIG. 2. As shown, one side of the user's forearm rests against rest/leverage plate 130 with the opposite side of the forearm being restrained by web 156 of brace 150. The extended forearm is then bent at the elbow as in the conventional biceps curl. Upon such user-movement the bolt 340 rotates about its imaginary longitudinal axis, as provided by bearing 330 which allows for rotation of the weight 900 clamped thereto. This rotation enhances the use of the device 10 and precludes the entire apparatus 10 from rotating about the forearm of the user during use.

I have found that the extension of the free weight 900 beyond the user's hand results in a more intensive exercise which in turn enhances the development of the biceps as well as the triceps and surrounding muscles.

Figure 6:
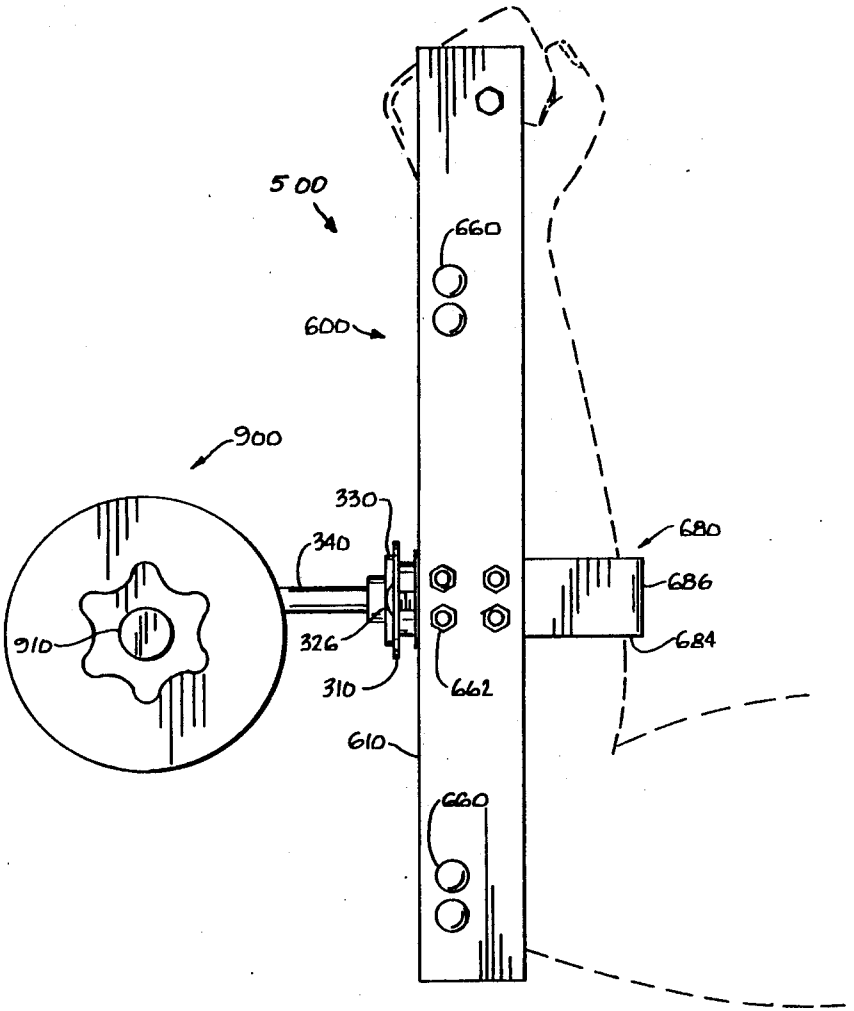
FIG. 6 is a side elevation view of the apparatus shown in FIG. 4 with an arm of the user inserted therein.
Figure 5:
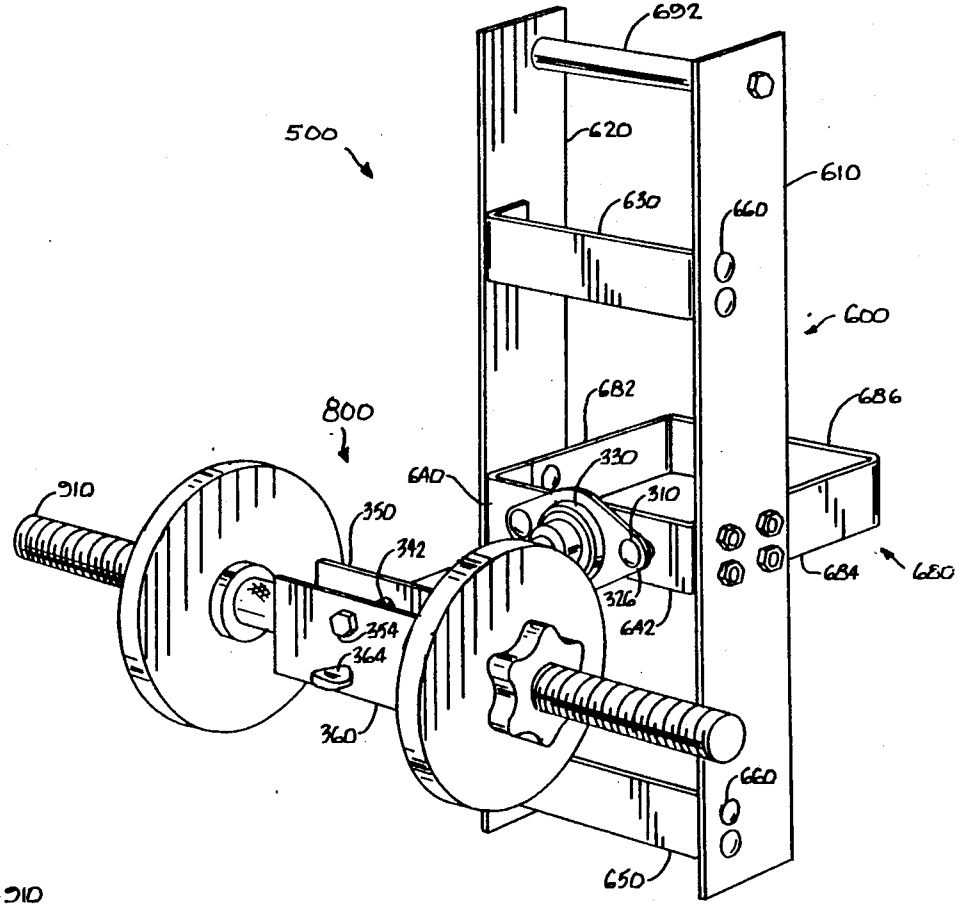
FIG. 5 is a perspective view of an exercise device for primarily performing the "fly" exercise.

An alternative embodiment 500 is shown in FIGS. 5–7 for the "fly" exercise. This embodiment 500 comprises a support assembly 600, handle 692 and a clamping assembly 800. The support assembly 600 comprises a pair of elongated struts 610, 620 with a plurality of U-shaped support/leverage struts 630, 640, 650 fastened therebetween by rivets 660 or nut/bolt combinations 662. Extending from the middle strut 640 in an opposed direction is a U-shaped restraint brace 680 having relatively elongated first and second arms 682, 684 with a web 686 extending therebetween. Web 686 is displaced from the struts 610, 620 so as to present an opening for extension of the fist and forearm of the user therethrough.

Extending between the struts 610, 620 at one end thereof is a bar 692 for grasping by the user upon extension of the fist/forearm through brace 680.

Attached to the underside of the web 642 of strut 640 is the clamping assembly 800. This assembly is identical to the clamping assembly 300 illustrated in FIGS. 1–4. As such, the assembly utilizes a flange plate 310 attached to web 642 by spacer nut/bolt combinations 326. A rotatable bearing 330 is rotatably nested within the flange plate 310. As earlier described an elongated bolt 340 extends through the bearing 330. As such, the bolt 340 is rotatable about its imaginary longitudinal axis. Located at the threaded end 342 of bolt 340 are the first and second clamping plates 350, 360.

As above-described, the threaded free end 342 of bolt 340 extends through the clamping plates 350, 360 with spaced-apart nuts 352, 354 being threaded thereon. Bolt 364 is releasably extendable through the clamping plates 350, 360 so as to allow for insertion of the bar 910 of the handle 910 of free weight 900 between the clamping plates 350, 360. Upon such insertion a wing nut 363 securely fastens the free end of bolt 364. The clamping plates 350, 360 bear against the handle 910 of free weight 900 as well as the spaced-apart bolts 342, 364 on each side of the handle 910. Accordingly, movement of the handle 910 between the bolts 342, 364 and the clamping plates 350, 360 is delimited.

Upon use of embodiment 500, the forearm of the user is inserted between strut 640 and brace 680 such that the lower arm is positioned between the struts 610, 620 and rests atop the central webs of the various struts/support plates 630, 640, 650. The hand of the user grasps the handle 692. Although one embodiment is shown in FIG. 6 it is understood that another embodiment is utilized for the opposing arm.

Normally the user is lying on a bench or the like so that the arms of the user are parallel to the floor. The user then brings the arms from this starting parallel position to a position in which the elbows touch each other. At this position the arms are perpendicular to the floor and the body of the user. Repetitions of this fly exercise are done as in the normal manner so as to enhance the muscle development. Again, during such motion the clamping assembly 800 is rotatable about the longitudinal axis of the bolt 340 so as to assist the user in performance of the exercise and enhance the result thereof. During such exercise, the U-shaped brace 680 delimits the forearm movement so as to preclude undesirable displacement of the forearm from the support/leverage plates 630, 640, 650 during exercise.

As above described, the clamping assemblies of the devices 10, 500 are essentially identical. Thus, my device allows for the use of a range of user-selectable weights according to the desired intensity of the exercise.

It is to be understood that while certain forms of this invention have been illustrated and described, it is not limited thereto, except in so far as such limitations are included in the following claims and allowable functional equivalents thereof.

Having thus described the invention, what is claimed as new and desired to be secured by Letters Patent is:

1. An exercise device for use with a weight of a user-selectable size comprising:

support means having a front end and a rear end for a forearm of said user;

a handle for grasping by the user;

means for connecting said handle to said support means generally adjacent said front end thereof;

clamping means for releasably receiving the weight therein, said clamping means comprising:

an elongated bolt having first and second ends;

a first clamping plate attached to said second bolt end;

a second clamping plate positioned about said bolt and displaceable from said first clamping plate; and means for connecting said first clamping plate to said second clamping plate, a portion of the weight being fixable therebetween;

means for associating said clamping means with said handle in movement therewith, said associating means including structure for joining said first end of said bolt to said handle with said elongated bolt extending said clamping plates away form the suer and beyond said front end of said support means, the weight resisting movement of said device by the user.

2. The device as claimed in claim 1 wherein said support means comprises:

a rest plate;

at least one elongated strut having front and rear ends with said handle being positioned generally adjacent said front end of said at least one strut by said connecting means;

means for attaching said rest plate generally adjacent said rear end of said strut, said rest plate offering support to the forearm of the user during said user-movement.

3. The device as claimed in claim 2 further comprising means for delimiting movement of the forearm from said rest plate during said user movement.

4. The device as claimed in claim 3 wherein said delimiting means comprises:

a second plate;

means for displacing said second plate opposite said rest plate for insertion of said forearm therebetween;

said second plate restraining movement of said forearm during said user movement.

5. The device as claimed in claim 4 wherein said displacing means comprises:

at least one strut having first and second ends;

means for attaching a first end of said strut to said second plate;

means for attaching a second end of said strut to said rest plate with said second plate spaced from said rest plate for insertion of said forearm therebetween.

6. The device as claimed in claim 1 wherein said structure of said associating means comprises:

a flange plate;

an aperture in said flange plate;

means for joining said first end of said bolt to said flange plate with said elongated bolt extending through said aperture;

means for attaching said flange plate to said handle with said elongated bolt extending away from said handle.

7. The device as claimed in claim 6 wherein said joining means includes a bearing rotatably mounted within said flange plate aperture for reception of said bolt first end therein, said bearing allowing for rotatable movement of said bolt and the flexible weight clamped thereto during said user movement.

* * * * *

UNITED STATES PATENT AND TRADEMARK OFFICE

CERTIFICATE OF CORRECTION

PATENT NO. : 5,088,725

DATED : February 18, 1992

INVENTOR(S) : GENE W. ARNOLD

It is certified that error appears in the above—identified patent and that said Letters Patent is hereby corrected as shown below:

Column 4, line 65, delete "suer" and substitute --user--.

Column 5, line 19, delete "said" and substitute --the--.

Column 5, line 21, delete the second occurrence of "said" and substitute --the--.

Column 6, line 6, delete "said" and substitute --the--.

Signed and Sealed this

Twenty-seventh Day of April, 1993

*Attest:*

MICHAEL K. KIRK

*Attesting Officer*

*Acting Commissioner of Patents and Trademarks*